US007018309B2

(12) United States Patent
Kasashima et al.

(10) Patent No.: US 7,018,309 B2
(45) Date of Patent: Mar. 28, 2006

(54) GOLF BALL

(75) Inventors: Atsuki Kasashima, Chichibu (JP); Katsunori Sato, Chichibu (JP)

(73) Assignee: Bridgestone Sports Co., Ltd., Tokyo (JP)

( * ) Notice: Subject to any disclaimer, the term of this patent is extended or adjusted under 35 U.S.C. 154(b) by 0 days.

(21) Appl. No.: 10/837,743

(22) Filed: May 4, 2004

(65) Prior Publication Data

US 2005/0250604 A1 Nov. 10, 2005

(51) Int. Cl.
*A63B 37/12* (2006.01)

(52) U.S. Cl. ..... 473/383

(58) Field of Classification Search ..... 473/378–385
See application file for complete search history.

(56) References Cited

U.S. PATENT DOCUMENTS 4,830,378 A * 5/1989 Aoyama ..... 473/384
4,877,252 A * 10/1989 Shaw ..... 473/379
4,991,852 A * 2/1991 Pattison ..... 473/379
5,338,039 A * 8/1994 Oka et al. ..... 473/384
6,290,615 B1 9/2001 Ogg

FOREIGN PATENT DOCUMENTS

JP 07-289662 * 11/1995
JP 2003-047674 * 2/2003

* cited by examiner

*Primary Examiner*—Raeann Gorden
(74) *Attorney, Agent, or Firm*—Sughrue Mion, PLLC

(57) ABSTRACT

A golf ball has a surface on which numerous dimples are arranged with any dimple being surrounded by a plurality of adjoining dimples. Mutually adjoining dimples, each defined by a peripheral edge, have disposed therebetween an edge element which forms part of the peripheral edge. When the golf ball is manufactured with a two-part mold having two halves, the edge elements on or near a ball equator coincident with a parting line between the mold halves are continuously interconnected along the equator and some of the edge elements intersect the equator. The golf ball has dimple effects which enhance its aerodynamic performance and thus increase its carry.

17 Claims, 3 Drawing Sheets

GOLF BALL

BACKGROUND OF THE INVENTION

The present invention relates to a golf ball having an excellent flight performance.

It is well-known that, in a golf ball, the high rebound of the ball itself and the air resistance-reducing effects during flight by dimples arranged on the ball's surface play important roles in enabling the ball to achieve a long carry when hit. A variety of methods have been devised for arranging dimples as densely and uniformly as possible on the surface of the ball so as to reduce air resistance.

The dimples ordinarily employed are depressions that are circular as viewed from above. Because such circular dimples are used, even if, in order to arrange the circular dimples to a high density, neighboring dimples are placed so closely to each other that the width of the land separating two dimples approaches zero, lands of a certain size having triangular or quadrangular shapes of a certain extent are formed in areas surrounded by three or four thusly arranged dimples. Also, because it is critical to arrange dimples as uniformly as possible on the spherical surface of the ball, some degree of compromise on the density of the arrangement of circular dimples has been required.

To arrange the dimples both uniformly and to a high density, dimple configurations have been adopted in which from two to ten types of dimples of differing diameter are arranged on the spherical surface of the ball in the manner of a regular octahedron or a regular icosahedron.

However, so long as only circular dimples are used, the practical upper limit in dimple surface coverage, defined as the total surface area of the dimples as a proportion of the total surface area of the sphere, is about 75% (which corresponds to a land surface coverage of about 25%).

Unlike the dimples described above, U.S. Pat. No. 6,290,615 discloses a golf ball in which projections that extend out on a lattice (lattice members) are disposed over a smooth spherical surface, partitioning the surface into hexagonal shaped bounded areas and thereby reducing the land area.

However, the hexagonal shaped bounded areas delineated by the lattice members lie on a spherical surface having a center that coincides with the center of the ball and are not dimples, thus having a poor air resistance lowering effect.

SUMMARY OF THE INVENTION

Therefore, the object of the present invention is to provide a golf ball in which the aerodynamic performance is enhanced by dimple effects, enabling an increased carry to be achieved.

The inventors have conducted extensive investigations to achieve the above object. As a result, they have discovered that, in a golf ball having a surface on which numerous dimples are arranged with any dimple being surrounded by a plurality of adjoining dimples, the aerodynamic performance is enhanced by disposing between mutually adjoining dimples, each of which is defined by a peripheral edge, a narrowly extending edge element which forms part of the peripheral edge, and by densely arranging the dimples so as to substantially eliminate space for providing lands. The inventors have also discovered that, when the golf ball is manufactured in a two-part mold having two halves, a better flight symmetry can be achieved by arranging the edge elements on or near a ball equator coincident with a parting line between the mold halves so as to be continuously interconnected along the equator and so that some of the edge elements intersect the equator.

Accordingly, the invention provides the following golf ball.

(1) A golf ball having a surface on which numerous dimples are arranged with any dimple being surrounded by a plurality of adjoining dimples, characterized in that mutually adjoining dimples, each defined by a peripheral edge, have disposed therebetween an edge element which forms part of the peripheral edge, and in that, when the golf ball is manufactured with a two-part mold having two halves, the edge elements on or near a ball equator coincident with a parting line between the mold halves are continuously interconnected along the equator and some of the edge elements intersect the equator.

(2) The golf ball of (1), wherein the edge elements have a height of 0.02 to 0.2 mm and a width of 0.2 to 3.0 mm.

(3) The golf ball of (1), wherein at least 70% of all the edge elements have the same cross-sectional shape.

(4) The golf ball of (1), wherein substantially all edge elements other than at interconnections where edge elements mutually intersect and other than edge elements connected along the equator have the same cross-sectional shape.

(5) The golf ball of (1), wherein the edge elements have a cross-sectional shape that is circularly arcuate.

(6) The golf ball of (5), wherein the cross-sectional shape of the edge elements is rounded to a radius of curvature of 0.2 to 2.0 mm.

(7) The golf ball of (1), wherein the dimples have a shape as viewed from above that is polygonal.

(8) The golf ball of (7), wherein the dimples are formed in shapes as viewed from above which are primarily pentagonal.

BRIEF DESCRIPTION OF THE DIAGRAMS

DETAILED DESCRIPTION OF THE INVENTION

The golf ball is described in detail below in conjunction with the attached diagrams.

Figure 1:
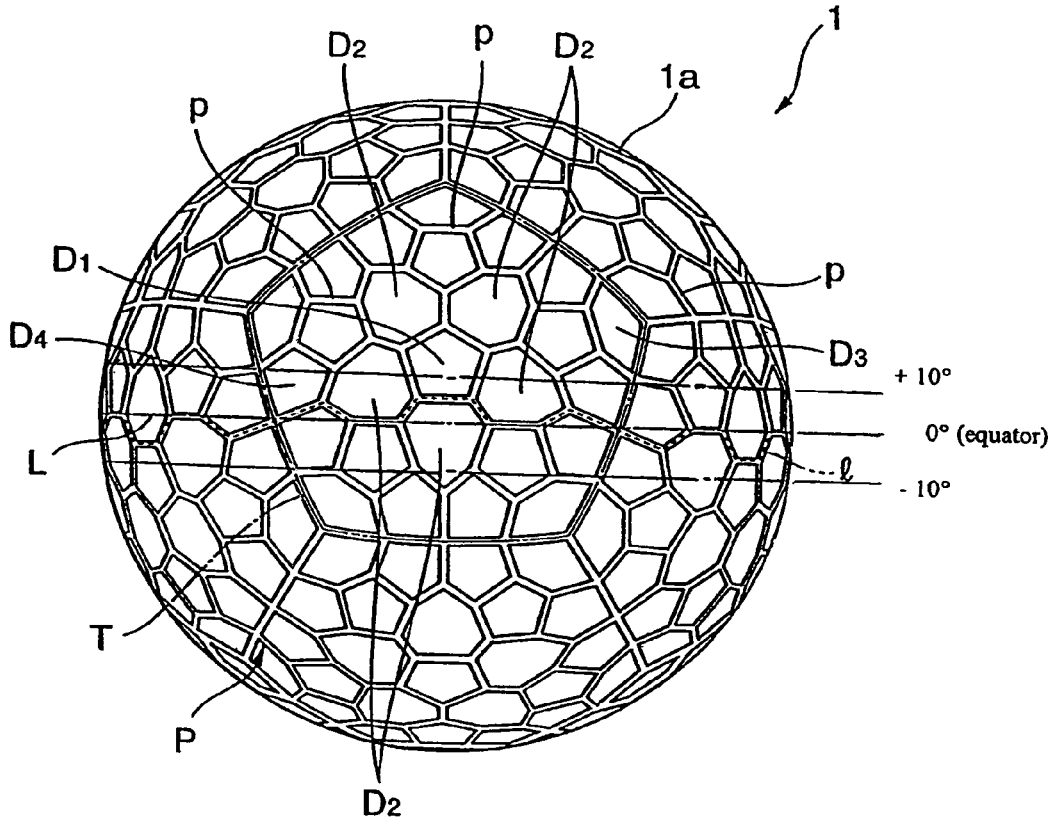
FIG. 1 is a plan view of a golf ball according to a first embodiment of the invention.
Figure 2:
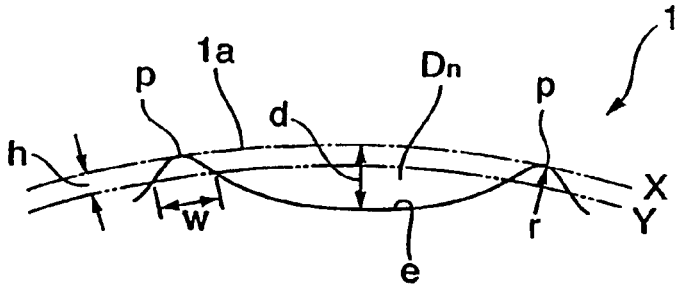
FIG. 2 is an illustrative view showing part of the ball surface in FIG. 1.
Figure 3:
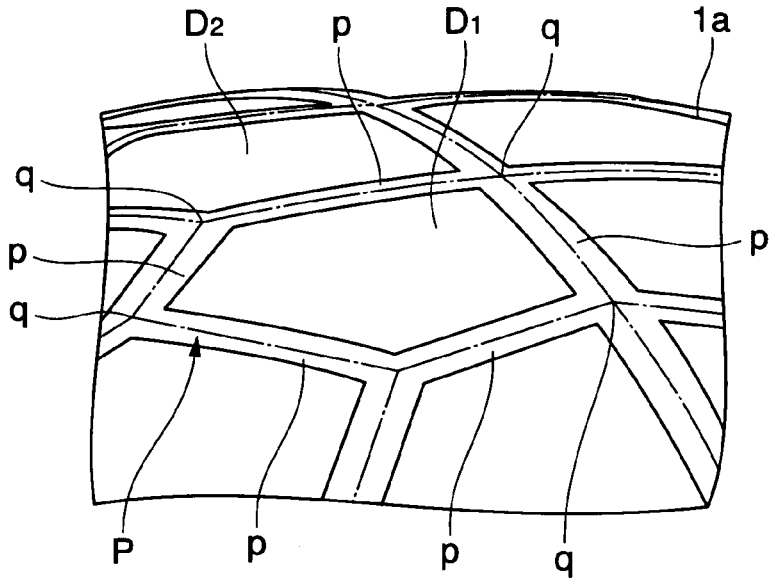
FIG. 3 is a partially enlarged view showing a dimple formed on the surface of the golf ball in FIG. 1.

FIG. 1 is a plan view of a golf ball 1 illustrating a first embodiment of the invention, FIG. 2 is an illustrative view showing part of the ball surface, and FIG. 3 is an enlarged view of a portion of FIG. 1.

In the golf ball 1 according to one embodiment of the invention, as shown in FIG. 1, numerous dimples are arranged on the ball's surface 1*a* with any dimples $D_1$ and $D_2$ being surrounded by a plurality of adjoining dimples. Specifically, FIG. 1 shows, as examples of any dimples, one pentagonal dimple $D_1$ positioned at the center of a unit pentagon T on a spherical dodecahedron (which dimple is referred to hereinafter as the "center dimple") and five heptagonal dimples $D_2$, $D_2$, $D_2$, $D_2$ and $D_2$ disposed around the center dimple $D_1$. The center dimple $D_1$ and the heptagonal dimples $D_2$ that adjoin it have formed therebetween edge elements p which make up part of the peripheral edge P of the center dimple $D_1$ and the heptagonal dimples $D_2$. That is, the peripheral edge P of a dimple Dn is composed of a plurality of edge elements p as its constituent units. Moreover, as indicated by the line l in FIG. 1, the edge elements p positioned on or near the ball's equator L, which is normally coincident with the parting line in a two-part mold, are circumferentially interconnected and the resulting circumferentially connected path has edge element p portions which change direction on one hemispherical side of the ball and on the other hemispherical side relative to the equator L.

Referring to FIG. 2, the edge elements p are formed between an outer circumferential surface 1*a* (denoted by single dot-and-dashed line) of the golf ball 1 and a baseline Y (concentric circle denoted by double dot-and-dashed line) separated by a distance h toward the center of the ball from the position of an extension X of the outer circumferential surface 1*a*. The distance h is generally from 0.02 to 0.2 mm, and corresponds to the height of the edge elements p. The width w at the plane of intersection between the edge elements p and the baseline Y is preferably from 0.2 to 3.0 mm.

The edge elements p have a cross-sectional shape which is not subject to any particular limitation. However, to reduce air resistance, a shape having a rounded aspect is preferable to a polygonal or other angular shape, and a shape that is circularly arcuate is especially preferred. When the edge elements p have a cross-sectional shape which is circularly arcuate, it is advantageous for the shape to have a radius of curvature r of 0.2 to 2.0 mm. The distance d from the line X passing through the apices of the edge elements p to the deepest part e of the dimple Dn is preferably in a range of 0.1 to 0.4 mm. It is preferable for the dimple Dn to have a shape at the bottom which is circularly arcuate like that of dimples generally used on golf balls or is of a similar concave shape. Insofar as the objects of the invention can be achieved, it is also possible for the dimple Dn to have a bottom shape that is flat.

If an edge element p is formed convexly outward at a radius of curvature r, the two end positions of the edge element p on the baseline Y each correspond to points of inflection between this convex shape and the concave shape making up most of the dimples Dn.

It is advantageous for the edge elements p to have a cross-sectional shape which is the same in as many places as possible. Preferably at least 70% of all the edge elements have the same cross-sectional shape. Specifically, it is desirable for substantially all the edge elements p, other than interconnections q where the five edge elements p intersect in the pentagonal dimple $D_1$ shown in FIG. 3 and other than, in the vicinity of the equator L denoted by the dotted line in FIG. 1, edge elements connected together in the equatorial direction and areas adjacent thereto, to have the same cross-sectional shape.

The arrangement of dimples Dn on the golf ball 1 is not subject to any particular limitation. In the embodiment shown in FIG. 1, a spherical dodecahedral arrangement is employed. A unit pentagon T serving as a constituent unit thereon is denoted with a single dot-and-dashed line, and polygonal dimples Dn are uniformly arranged within the unit pentagon. More specifically, a pentagonal center dimple $D_1$ which is substantially similar to the unit pentagon T is disposed at a center position within the unit pentagon T such that each side of the dimple is parallel to the respective side of the unit pentagon T. Five heptagonal dimples $D_2$ are disposed around the center dimple $D_1$. The resulting collection of dimples exhibits a petal-like dimple pattern on the surface of the ball. Interposed between the center dimple $D_1$ and each adjoining heptagonal dimple $D_2$ is a shared edge element p. The unit pentagon T is provided at each of its five vertices with a pentagonal dimple $D_3$ inscribed within the vertex. Around each of these dimples $D_3$ at the vertices, a total of three other pentagonal dimples $D_4$ which are substantially the same shape as the center dimple $D_1$ has been arranged within the unit pentagon T. Therefore, a single unit pentagon T contains a total of 26 dimples consisting of one center dimple $D_1$, five heptagonal dimples $D_2$, five pentagonal dimples $D_3$ and 15 other pentagonal dimples $D_4$.

The pentagonal dimples account for preferably at least 50%, and more preferably at least 70%, of all the dimples. For a uniform dimple arrangement, an upper limit of about 90% is desirable.

Figure 4:
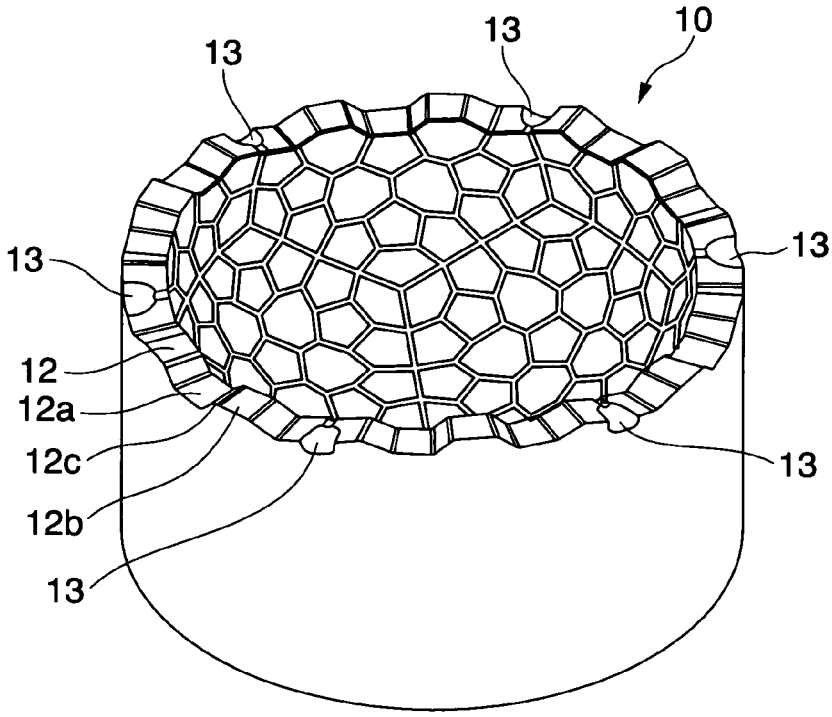
FIG. 4 is a perspective view showing the bottom half of a mold that may be used to manufacture the golf ball in FIG. 1.

FIG. 4 is a perspective view showing the bottom half 10 of a two-part mold for making golf balls 1 according to the embodiment shown in FIG. 1. This mold 10 has a parting line 12 which coincides with the series of connected edge elements p denoted by the dotted line in FIG. 1. In FIG. 1, for the sake of convenience, only one of six unit pentagons T situated along the equator L is denoted with a single dot-and-dashed line. In this unit pentagon T, the series of edge elements p (dotted line portions) which coincides with the parting line 12 is composed of, interconnected on one hemisphere, portions that extend parallel with the equator, portions that extend at an angle to the equator and portions that extend on the equator. Moreover, within both unit pentagons adjoining this unit pentagon T, the series of edge elements p (dotted line portions) is composed of, interconnected on the other hemisphere, portions that extend parallel with the equator, portions that extend at an angle to the equator, and portions that extend on the equator. Therefore, in the equatorial direction as a whole, the portions that extend on one hemisphere and the portions that extend on the other hemisphere are formed in an even balance with respect to the equator L. Moreover, in the series of edge elements p connected along the equator, interconnections q between the edge elements p are positioned on the equator.

In the unit pentagon T shown in FIG. 1, the dimples Dn which cross the equator and extend from one hemisphere into the other hemisphere include two pentagonal dimples $D_3$ and one heptagonal dimple $D_2$, although it is a condition here that the deepest portion e at the bottom of these dimples Dn not cross and extend beyond the equator L. Were the deepest portion e at the bottom of a dimple Dn to cross and extend beyond the equator, removing the golf ball after it has been injection molded in the mold shown in FIG. 4 would be difficult. To prevent such a problem, it is preferable for edge elements p which cross the equator L and extend into the other hemisphere to be situated within a zone of ±10° centered on the equator L.

In FIG. 4, gates 13 for the injection of cover resin material are provided on the mold parting line 12. In this embodiment, six gates 13 are provided at equally spaced intervals on the equator L. However, other embodiments are also possible, such as ones in which six to ten gates are provided also in areas away from the equator L. To ensure the uniform inflow of cover resin to the interior of a two-part mold having a bottom half and a top half, it is preferable for the gates 13 to be disposed with well-balanced symmetry with respect to the equator L. The cross-sectional shape of the gates 13 is not subject to any particular limitation, although a cross-section that is circular and has a diameter in a range of 0.5 to 1.0 mm is preferred. In addition to a circular shape, at edge element p positions, the gates 13 may be provided with a cross-sectional shape which is rectangular along the edge element. In such cases, the cross-sectional area of the gate 13 can be adjusted so as to be the same as the cross-sectional area of the gates of circular cross-section.

By imparting roundness to the respective bent junctions between recessed areas 12*a*, raised areas 12*b* and inclined border areas 12*c* on the parting line 12 of the mold, the durability of the mold can be improved. A roundness represented numerically by a radius of curvature of 0.2 to 2.0 mm is preferred.

In the above golf ball 1, after the cover has been molded, flash generally forms along the parting line 12 of the mold, and must be removed by buffing. To prevent the circumferential edges, or edge elements p, of the dimples Dn from being buffed more than necessary by the buffing means, it is desirable for the series of edge elements p that extends circumferentially coincident with the parting line L, i.e., the edge elements p that extend circumferentially coincident with the dotted line in FIG. 1, and nearby edge elements p, to be formed to a height (see FIG. 2) which is 0.005 to 0.1 mm higher than in other areas.

In the invention, dimples having a shape as viewed from above which is circular, triangular, quadrangular, pentagonal, hexagonal, heptagonal or of some other, irregular, shape may be used alone or in suitable combinations. Aside from the spherical dodecahedral arrangement in the present embodiment, other dimple arrangements that may be suitably used on the outside surface of the ball include regular polyhedral arrangements such as spherical icosahedrons, spherical octahedrons, spherical hexahedrons and spherical tetrahedrons. Use can also be made of a method for uniformly arranging dimples within spherical triangles obtained by dividing a hemisphere into 3 to 12 equal parts with meridians from one pole of the ball that are orthogonal to the equator.

Manufacture of the mold can be carried out by either directly cutting out the mold as shown in FIG. 4 using a ball-nosed end mill on a machine tool with three-dimensional CAD/CAM technology, or by using a ball-nosed end mill on such a machine tool to cut out dimples on a spherical surface as a male master mold, then reversing the pattern to form the golf ball mold.

Fabricating a mold for the above-described golf ball using a machine tool equipped with a 3D CAD/CAM system is easy. The mold can be inexpensively fabricated by cutting it out directly using a numerically controlled machine tool running on a program created with 3D CAD/CAM software. The tool preferably uses a ball-nosed end mill. When shaping particularly difficult-to-cut dimple-forming projections in the vicinity of the parting line or the equator, it is possible to cut the deep recesses of the projections by using a ball-nosed end mill in which the cutter portion formed at the working end of the mill has a trajectory during rotation which is spherically extended from the axis of rotation and exhibits a virtual shape during rotation that is spherical. Accordingly, use can be made of a three-axis machine having an x-axis, y-axis and z-axis, and having a spindle on which a tool such as a ball-nosed end mill rotates. If the cutter teeth have a radius of about 0.5 to 1.5 mm, during the machining of projections in the vicinity of the parting line, the cutter can be effectively used even when the projections have a complex shape.

Figure 5:
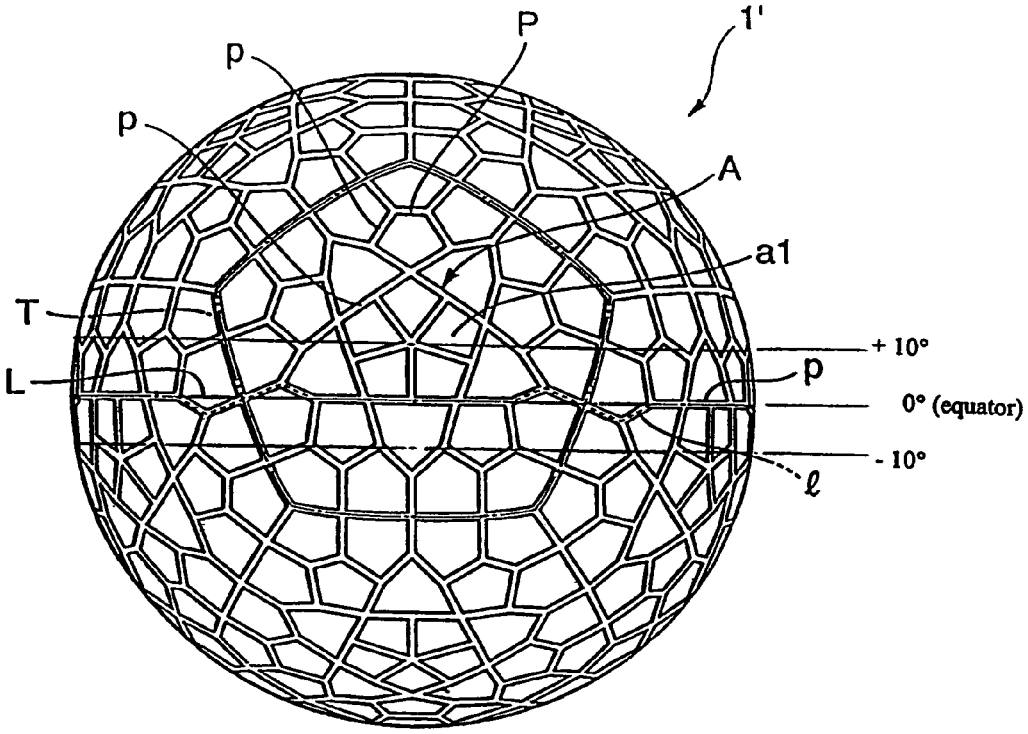
FIG. 5 is a plan view showing a golf ball according to a second embodiment of the invention.
Figure 6:
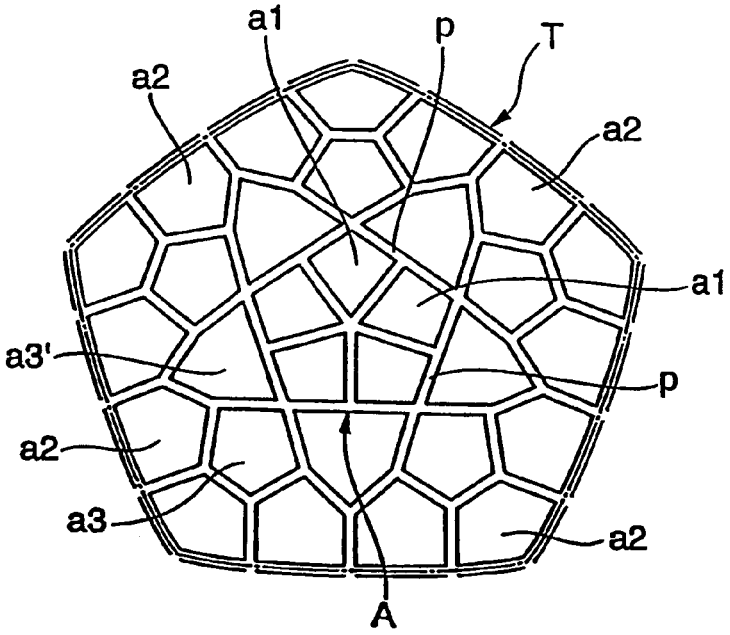
FIG. 6 is a partially enlarged view showing the arrangement of dimples within a unit pentagon in FIG. 5.

FIG. 5 is a plan view of a golf ball 1' illustrating a second embodiment of the invention. As in the first embodiment, this golf ball 1' employs a spherical dodecahedral arrangement composed of unit pentagons T like that denoted by the single dot-and-dashed line. This golf ball 1' has a dimple arrangement in which, as shown in FIG. 6, a pentagonal region A substantially similar to the unit pentagon T is demarcated by ten edge elements p and is divided by five additional edge elements p into five uniform quadrangular dimples a1. In addition, 15 pentagonal dimples a2 are disposed along the inside of the unit pentagon T on the respective sides thereof. In the region between the above pentagonal region A and the above 15 pentagonal dimples a2 are disposed a total of 10 slightly deformed pentagonal dimples of two types a3 and a3'. Therefore, a single unit pentagon T contains a total of 30 dimples, consisting of five quadrangular dimples a1, 15 pentagonal dimples a2, and 10 pentagonal dimples of differing types a3 and a3'.

In FIG. 5, the edge elements p on or near the equator L of the ball are connected along the equator while changing direction from one hemisphere to the other hemisphere, and thus have characteristics like those in the first embodiment.

Although some preferred embodiments have been described, many modifications and variations may be made thereto in light of the above teachings without departing from the spirit and scope of the invention. The invention is also not subject to any particular limitation with regard to the construction of the ball, and can be applied to all types of golf balls, including solid golf balls such as one-piece golf balls, two-piece golf balls and multi-piece golf balls having three or more layers, as well as thread-wound golf balls. Particularly advantageous use can be made of a multilayer construction having a solid elastic core and a cover with one or more intermediate layer disposed therebetween. Ball specifications such as weight and diameter may be set as appropriate under the Rules of Golf.

The invention claimed is:

1. A golf ball having a surface on which numerous dimples are arranged with any dimple being surrounded by a plurality of adjoining dimples, characterized in that mutually adjoining dimples, each defined by a peripheral edge, have disposed therebetween an edge element which has a cross-sectional shape having a constant height and a constant width with respect to a longitudinal axis of the edge element and forms part of the peripheral edge, wherein the edge elements have a cross-sectional shape that is circularly arcuate and has a radius that is different from the outer radius of the golf ball, and in that, when the golf ball is manufactured with a two-part mold having two halves, the edge elements on or near a ball equator coincident with a parting line between the mold halves are continuously interconnected along the equator and some of the edge elements extend at an angle to the equator from one hemisphere through an interconnection between the edge elements to another hemisphere.

2. The golf ball of claim 1, wherein the edge elements are defined by a point of inflection at the peripheral edge of the respective dimples, and wherein the edge elements have a height of 0.02 to 0.2 mm and a width of 0.2 to 3.0 mm.

3. The golf ball of claim 1, wherein at least 70% of all the edge elements have the same cross-sectional shape.

4. The golf ball of claim 1, wherein, except for edge element connected along the equator, substantially all other edge elements have the same cross-sectional shape except for the cross-sectional shape at interconnection points with other edge elements.

5. The golf ball of claim 1, wherein the dimples have a shape as viewed from above that is polygonal.

6. The golf ball of claim 5, wherein the dimples are formed in shapes as viewed from above which are primarily pentagonal.

7. The golf ball of claim 6, wherein the pentagonal dimples account for at least 50% of all the dimples.

8. The golf ball of claim 6, wherein the pentagonal dimples account for 70 to 90% of all the dimples.

9. The golf ball of claim 1, wherein the series of edge elements on or near the ball equator is composed of portions that extend at an angle to the equator and portions that extend on the equator.

10. The golf ball of claim 1, wherein the edge elements, which cross the equator and extend into the other hemisphere, are situated within a zone of ±10° centered on the equator.

11. A golf ball having a surface on which numerous dimples are arranged with any dimple being surrounded by a plurality of adjoining dimples, characterized in that mutually adjoining dimples, each defined by a peripheral edge, have disposed therebetween an edge element which has a circularly acurate cross-sectional shape rounded to a radius of curvature of 0.2 to 2.0 mm and forms part of the peripheral edge, and in that, when the golf ball is manufactured with a two-part mold having two halves, the edge elements on or near a ball equator coincident with a parting line between the mold halves are continuously interconnected along the equator and some of the edge elements intersect the equator.

12. A golf ball having a surface on which numerous dimples are arranged with any dimple being surrounded by a plurality of adjoining dimples, characterized in that mutually adjoining dimples, each defined by a peripheral edge, have disposed therebetween an edge element which has a cross-sectional shape having a constant height and a constant width with respect to a longitudinal axis of the edge element and forms part of the peripheral edge, and in that, when the golf ball is manufactured with a two-part mold having two halves, the edge elements on or near a ball equator coincident with a parting line between the mold halves are continuously interconnected along the equator and some of the edge elements extend at an angle to the equator from one hemisphere through an interconnection between the edge elements to another hemisphere, wherein the series of edge elements on or near the ball equator is composed of portions that extend parallel with the equator, portions that extend at an angle to the equator, and portions that extend on the equator.

13. A golf ball having a surface on which numerous dimples are arranged with any dimple being surrounded by a plurality of adjoining dimples, characterized in that mutually adjoining dimples, each defined by a peripheral edge, have disposed therebetween an edge element which has a cross-sectional shape having a constant height and a constant width with respect to a longitudinal axis of the edge element and forms part of the peripheral edge, and in that, when the golf ball is manufactured with a two-part mold having two halves, the edge elements on or near a ball equator coincident with a parting line between the mold halves are continuously interconnected along the equator and some of the edge elements extend at an angle to the equator from one hemisphere through an interconnection between the edge elements to another hemisphere, wherein the dimples are composed of pentagonal dimples and other polygonal shaped dimples and the pentagonal dimples account for 50 to 90% of all the dimples.

14. A golf ball having a surface on which numerous dimples are arranged with any dimple being surrounded by a plurality of adjoining dimples, characterized in that mutually adjoining dimples, each defined by a peripheral edge, have disposed therebetween an edge element which has a cross-sectional shape having a constant height and a constant width with respect to a longitudinal axis of the edge element and forms part of the peripheral edge, and in that, when the golf ball is manufactured with a two-part mold having two halves, the edge elements on or near a ball equator coincident with a parting line between the mold halves are continuously interconnected along the equator and some of the edge elements extend at an angle to the equator from one hemisphere through an interconnection between the edge elements to another hemisphere, wherein the dimples have a distance from the line passing through the apices of the edge elements to the deepest part of the dimple is in a range of 0.1 to 0.4 mm.

15. A golf ball having a surface on which numerous dimples are arranged with any dimple being surrounded by a plurality of adjoining dimples, characterized in that mutually adjoining dimples, each defined by a peripheral edge, have disposed therebetween an edge element which has a cross-sectional shape having a constant height and a constant width with respect to a longitudinal axis of the edge element and forms part of the peripheral edge, and in that, when the golf ball is manufactured with a two-part mold having two halves, the edge elements on or near a ball equator coincident with a parting line between the mold halves are continuously interconnected along the equator and some of the edge elements extend at an angle to the equator from one hemisphere through an interconnection between the edge elements to another hemisphere, wherein the series of the edge elements that extends circumferentially coincident with the parting line and nearby edge elements are formed to a height which is 0.005 to 0.1 mm higher than in other areas.

16. A golf ball having a surface on which numerous dimples are arranged with any dimple being surrounded by a plurality of adjoining dimples, characterized in that mutually adjoining dimples, each defined by a peripheral edge, have disposed therebetween an edge element which has a cross-sectional shape having a constant height and a constant width with respect to a longitudinal axis of the edge element and forms part of the peripheral edge, and in that, when the golf ball is manufactured with a two-part mold having two halves, the edge elements on or near a ball equator coincident with a parting line between the mold halves are continuously interconnected along the equator and some of the edge elements extend at an angle to the equator from one hemisphere through an interconnection between the edge elements to another hemisphere, wherein the dimples are disposed by a spherical dodecahedron arrangement wherein the dimples including pentagonal dimples are uniformly disposed within each unit pentagon constituting the spherical dodecahedron.

17. The golf ball of claim 16, wherein the unit pentagon is provided at each of its five vertices with a pentagonal dimple inscribed within the vertex.

* * * * *